United States Patent [19]

Scharnweber et al.

[11] Patent Number: 4,970,427

[45] Date of Patent: Nov. 13, 1990

[54] ELECTRODE ARRANGEMENT FOR ESTABLISHING A SUSTAINED ELECTRICAL ARC

[75] Inventors: David H. Scharnweber, Milford; Lyle O. Hoppie, West Bloomfield; Donald R. Haefner, Oak Park, all of Mich.

[73] Assignee: Eaton Corporation, Cleveland, Ohio

[21] Appl. No.: 291,011

[22] Filed: Dec. 28, 1988

[51] Int. Cl.[5] ..... H01T 13/24

[52] U.S. Cl. ..... 313/146; 313/125; 313/141; 123/153; 123/155

[58] Field of Search ..... 313/125, 126, 141, 146, 313/147; 123/169 EL, 169 EA, 153, 155, 163

[56] References Cited

U.S. PATENT DOCUMENTS

| | | | |
|---|---|---|---|
| 1,298,821 | 4/1919 | Sutton | 313/126 X |
| 3,908,146 | 9/1975 | Pasbrig | 313/125 |
| 4,582,475 | 4/1986 | Hoppie | 431/6 |
| 4,672,938 | 6/1987 | Hoppie et al. | 123/538 |
| 4,757,788 | 7/1988 | Simons | 123/154 |

OTHER PUBLICATIONS

Harder et al., "Correlation of High Pressure Arc Heater Results," AIAA Journal, vol. 8, No. 12, pp. 2220–2225, 12/70.

Eschenbach et al., "Characteristics of High Voltage Vortex-Stabilized Arc Heaters", IEEE Transactions of Nuclear Science, pp. 41–46, 1/64.

*Primary Examiner*—Kenneth Weider

*Attorney, Agent, or Firm*—John R. Benefiel

[57] ABSTRACT

An electrode arrangement for establishing a sustained electrical arc with a low voltage in which a pair of electrodes are initially brought together and then separated while a current is applied. The sustained arc is adapted to activate fuel flowing past the arc, and the flow is vortical so that the arc is caused to migrate around an annular arc gap space. Several geometric configurations of the electrodes include opposing cylindrical shapes having endwise alligned cavities and a generally tapered portions of one electrode received in a generally tapered opening in the other electrode.

14 Claims, 4 Drawing Sheets

ELECTRODE ARRANGEMENT FOR ESTABLISHING A SUSTAINED ELECTRICAL ARC

FIELD OF THE INVENTION

This invention concerns devices for establishing an electrical arc.

BACKGROUND OF THE INVENTION

Electrical arcs have been widely employed for fuel ignition in combustion devices, a typical example being the use of spark plugs in internal combustion engines. Spark plugs generate a short duration electrical arc across the electrodes by impressing a very high voltage potential between the electrodes, i.e., 25,000–50,000 volts or higher, which leads to an initial electrical discharge across the gap at relatively high current levels on the order of several hundred amperes.

There has also been employed so called "make and break" spark igniters in which relatively movable electrodes are in contact and momentarily separated to create a spark between the electrodes.

Such ignition systems have not in recent times been employed for engine ignition in favor of the fixed gap spark plug ignition systems due to excessive erosion of the electrodes exposed to the combustion process.

U.S. Pat. No. 4,757,788 describes a recent attempt to apply the "make and break" ignition systems in an internal combustion engine.

Electrical arcs have also been employed as heaters, in which an electrical arc is sustained while a gas is circulated over the arc to heat the gas rapidly to high temperatures. Such heaters use a vertical flow of gas to stabilize the arc, causing it to rotate around cavities within opposing electrodes to alleviate the severe electrode erosion problem which would otherwise be encountered by a sustained electrical arc heating the electrode surface.

In U.S. Pat. No. 4,672,938, assigned to the same assignee as the present application, there is described an "activation" of fuel by the formation of molecular radicals in the fuel prior to combustion, so as to achieve "hypergolic" combustion, i.e., combustion with only a negligible delay after introduction of the fuel into an oxidizing atmosphere. Such activation may be accomplished by an electrical arc, and indeed may be the mechanism whereby spark ignition normally occurs.

In copending application Ser. No. 290,976, now U.S. Pat. No. 4,865,003, by the present inventors, there is disclosed the activation of fuel preparatory to combustion by exposing the fuel to an arc sustained for a period sufficient to activate a substantial proportion of the fuel charge burned, as in an internal combustion engine. While for this situation an arc need only be sustained for a relatively brief period compared to arc heaters, its duration is sufficient to necessitate solving the electrode erosion problem. Maintenance problems, even if only moderate, desirably should be avoided if possible. Thus, the arc should only be sustained for the period necessary for activation of each fuel charge, but it is desirable to maximize the exposure of the fuel charge to the electrical arc to enhance the activating effect of the arc on the fuel charge.

It is an object of the present invention to provide electrode arrangements for establishing a sustained arc to which a charge of fuel may be exposed so as to activate a substantial proportion of the charge, and which does not require a high voltage to initiate nor result in excessive electrode erosion.

SUMMARY OF THE INVENTION

These and other objects of the present invention as will be understood upon a reading of the following specification and claims are accomplished by an arrangement of electrodes which involves a relatively movable mounting of the electrodes from an initial position having annular surface portions in contact to an operative position with the portions separated a distance corresponding to the arc gap. A current is established with the electrode portions in contact such that as the electrodes are drawn apart, an arc is established between the electrode portions, negating the necessity of a 25,000–50,000 volt power supply.

The fuel passes through the annular space between the separated electrode portions in a vertical flow pattern matching the annular configuration of the space. The vertical fuel flow impinges on the arc, causing it to continuously be shifted about the electrode surfaces. This shifting movement of the arc maximizes exposure of the fuel charge to the arc and minimizes electrode erosion, while achieving good mixing of the fuel molecule radicals.

The separation of the electrodes is preferably achieved by the pressure of the fuel acting on one of the electrodes causing it to be shifted against the bias of a closing spring away from the other relatively fixed electrode.

The electrodes may take several different forms, including opposing cylinders having open ended cavities with rim surfaces facing each other, the rims comprising the contacting surfaces.

A generally conical hyperbolically curved electrode shape may also be employed, with a similarly contoured surface in the opposite electrode to obtain an acceleration of the vertical flow while maintaining a constant axial component of the fuel flow.

A simple poppet valve and seat may also be employed as electrode shapes where electrode erosion is not a major problem.

One electrode may carry an extension rod extending into a cylindrical bore in the opposite electrode to provide an additional path down which the arc may travel to increase its duration.

Tangential jet orifices may be used to inject the activated fuel charge in a widely dispersed pattern, or an open bore may inject the fuel in a narrower flow pattern.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
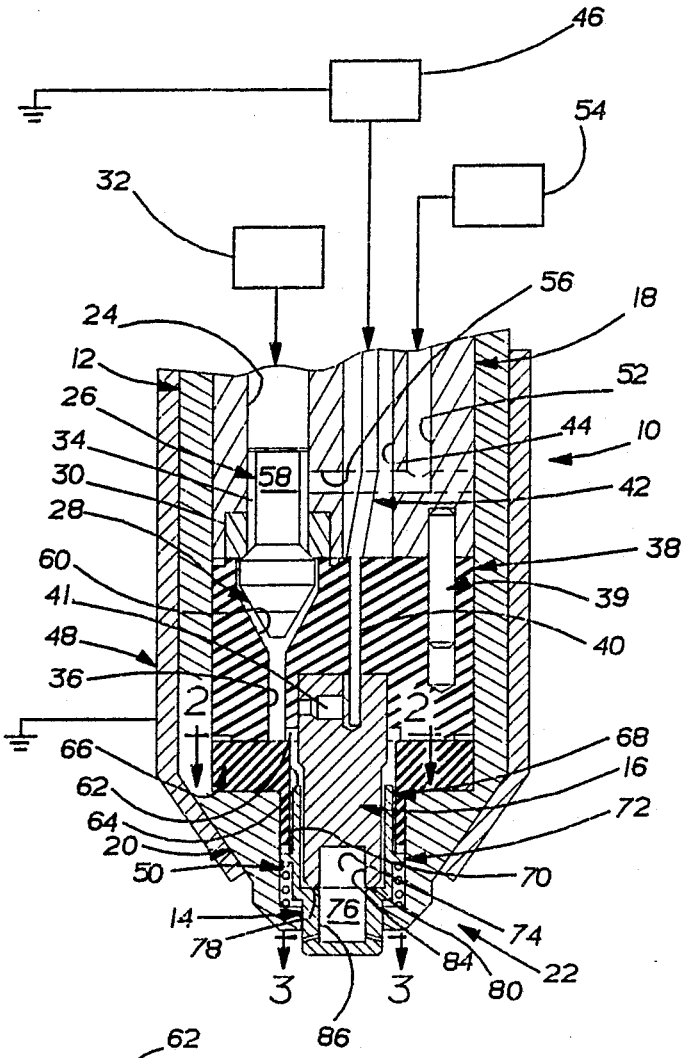
FIG. 1 is a fragmentary sectional of a fuel injector incorporating an electrode arrangement according to the present invention.
Figure 2:
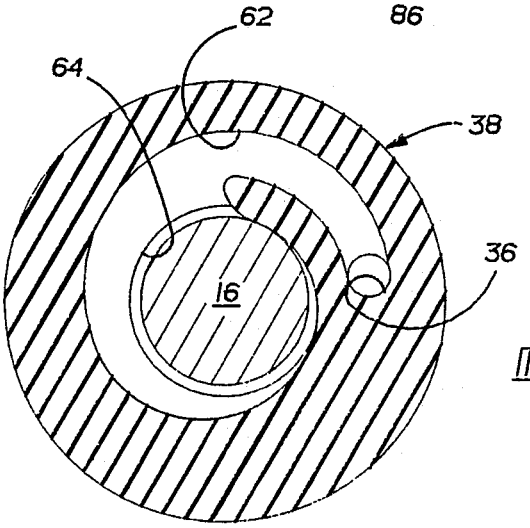
FIG. 2 is a view of the section 2—2 taken in FIG. 1.
Figure 3:
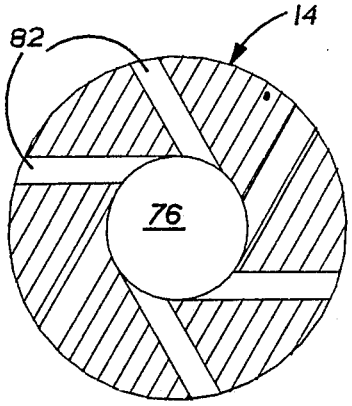
FIG. 3 is a view of the section 3—3 taken in FIG. 1.

Referring to FIGS. 1–3, the electrode arrangement according to the present invention is shown incorporated into a fuel injector 10, as for cyclically directing a charge of fuel into the combustion chamber of an internal combustion engine (not shown).

The injector 10 includes a housing means 12 mounting a pair of electrodes 14, 16. The housing 12 includes an inner member 18 and an outer member 20 extending forwardly and forming a tip end 22 of the injector 10. A first lengthwise bore 24 in inner housing member 18 accommodates an actuator rod 26 integral with a fuel flow control valve member 28 disposed within a valve seat 30. An actuator 32, such as a solenoid, is drivingly coupled to the actuator rod 26 to enable the valve member 28 to be moved off the valve seat 30 to establish communication between a clearance space 34 defining a fuel flow passage and a bore 36 formed in an electrically insulating spacer member 38 comprising part of the housing means 12. Spacer member 38 is secured against rotation in the outer housing by a dowel 39 staking it to the inner housing member 18.

The spacer mounts one end of the inner fixed electrode 16, and receives a conductor 40 of a cable 42 passed through a second lengthwise bore 44 in the inner housing member 18, conductor 40 secured to electrode 16 with a set screw 41. A current is caused to flow through electrodes 14, 16 by an arc driver circuit 46 described hereinafter. Electrical contact is typically applied by using the engine as circuit ground, and the injector 10 fit to the engine block via a jacket 48. Thus, the outer housing member 20 and contacting spring 50 establish electrical contact to the electrode 14 as shown.

A third lengthwise bore 52 formed in the inner housing member 18 is supplied with pressurized fuel from a source 54, such as a compressor or pump able to supply vaporized or gaseous fuel at a sufficiently high pressure for the particular application, 1500–3000 psig typically required to supply the fuel for a multicylinder piston engine.

A cross passage 56 communicates the fuel passage 52 with the space 34, with land 58 of actuator rod 26 pressure balancing the valve member 28 to enable rapid opening of the valve 28 by the actuator 32.

The valve member 28 has a generally conical shape received in a correspondingly shaped divergent section 60 of the bore 36. Preferably, a constant area clearance is established along the depth of valve member 36 by the contour of section 60 to avoid any restricting effect, minimizing flow losses and reflection of shock waves created by rapid opening of the valve member 36.

Bore 36 terminates at the inlet of a spiral recess 62 formed in the lower end face of the spacer member 38. As seen in FIG. 2, the spiral converges around the end of the electrode 16. The electrode 16 passes into a bore 64 of a bushing member 66 disposed within the outer housing member 20 and also comprising in part the housing means 12, bore 64 being of larger diameter than the OD of the electrode 16 such that the clearance therebetween defines an annular axially extending passage receiving vertical flow passing out from the spiral recess 62. The spiral shape insures that the tangential and axial components of fluid flow into the bore 64 are substantially uniform around the perimeter.

An upwardly extending skirt portion 68 of the lower electrode 14 is received into the bore 64, but with a clearance space on the order of 0.020 inches between the inside of the skirt 68 and electrode 16, this space defining an axially extending flow passage. In order to prevent electrical contact and insure that only the spring 50 transmits the electrical current, bushing member 66 and its extension 70 is constructed with an insulating material.

The lower electrode 14 is also formed with a radially extending flange 72 engaged by the spring 50 which is confined by the inside of the end wall of the outer housing member 20 to urge the lower electrode 14 towards the upper electrode 16.

The upper electrode 16 is formed with an open-ended cavity 74 recessed into the end face opposite the lower electrode 14, which has an aligned open ended cavity 76 recessed into the upper end opposite the upper electrode 16. The rim 78 of the cavity 74 and the rim 80 of the cavity 76 are brought into contact by the spring 50 in a first relative position of the electrodes 14, 16, with the valve member 28 closed. The cavity 76 of the lower electrode 14 is closed at the bottom thereof, but a series of tangential orifices 82 extend outwardly to inject the fuel into a combustion chamber (not shown) after activation by the electrical arc, which outward pattern is desirable for maximum dispersal into the oxidizing atmosphere.

Upon opening of the valve member 28, fuel passes into the bore 36, pressurizing the upper surfaces of the lower electrode 14, causing it to be separated from the upper electrode 16. A current has been previously caused to flow from electrode 14, to 16, and an arc is established by a drawing action as the rims 78, 80 are separated.

A vertical flow of fuel about the upper electrode 16, induced by spiral recess 62 passes through the annular gap created between the electrodes 14, 16 by their separation.

Figure 4:
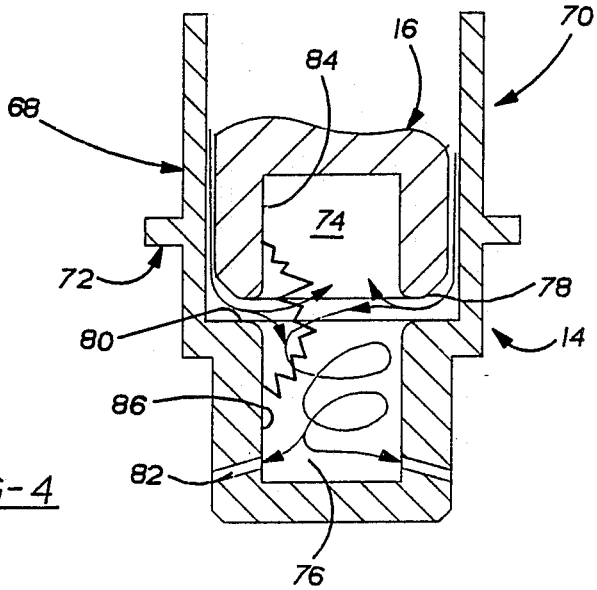
FIG. 4 is an enlarged fragmentary sectional view of the electrode portions of the fuel injector.

As shown in FIG. 4, flow is directed radially inward as well as tangentially, since passing from the space outside the larger diameter upper electrode 16 into the inside of the small diameter cavity 76. The radial component of the flow direction is directed against the arc in its initial position, causing the ends of the arc to migrate away from the rims 78, 80 to the inside surfaces 84, 86 of the cavities 74, 76, assuming a generally "C" shape due to re-entrant flow into cavity 74 and a low pressure region along the centerline created by the vertical flow. The tangential component of the fluid flow impinges on the C-shaped arc so as to cause the arc to rotate continuously within the surfaces 84, 86 of the cavities 74, 76. A sufficient gap of mobility of the arc should be established in order to insure this effect.

The shifting of the arc insures good exposure of the fuel charge to the arc for maximum activating effect of the fuel molecules, the fuel flow pattern also insuring good mixing of the activated molecules.

Equally importantly, the continuously shifting terminus locations of the migrating arc reduces localized heating of the surfaces of the electrodes, reducing erosion which would otherwise occur.

This arrangement of the electrodes allows a relatively low voltage source to be employed to establish and sustain the arc.

Figure 5:
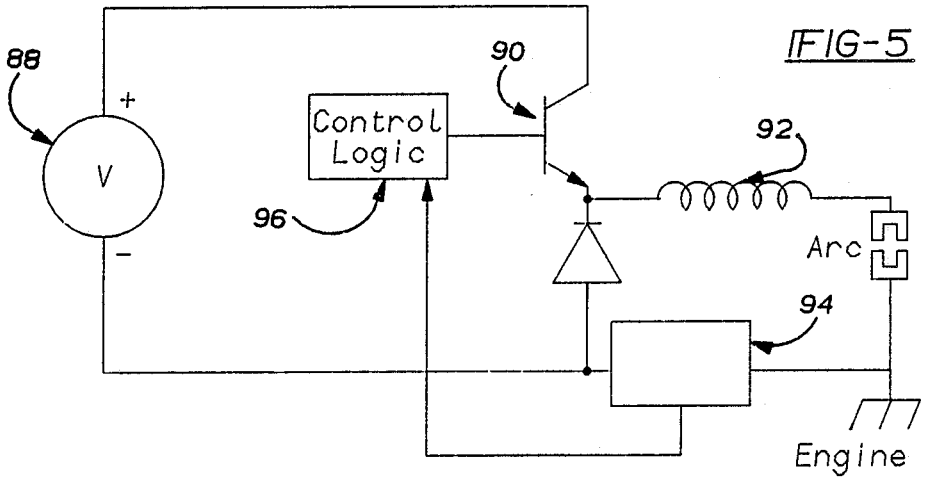
FIG. 5 is a diagram of an arc driver circuit associated with the electrode arrangement according to the present invention.

FIG. 5 shows a preferred arc driver circuit for establishing the electrical arc, including a 0–300 v DC power supply 88 connected across the electrodes 14, 16 via a Darlington power transistor 90 and a 3 millihenry "choke" coil 92.

Electrode 14 is connected into the circuit using the housing 12 as circuit ground, and, as noted above, the moving electrode 14 should be electrically connected via spring 50 to avoid establishment of sliding electrical contact with the contacting surfaces of the holder bushing 66.

A current sensor 94 provides feed back to a pulse width modulation current level control logic circuit 96 connected to the base of the Darlington transistor 90 to limit the current across the electrodes 14, 16.

A diode 98 provides a return path for current to flow from the choke coil 92 to electrodes 14, 16 as the transistor 90 is cycled to the off condition control circuit 96.

The control circuit 96 provides essential timing control of the arc current using engine position feed back signals, such as a crank angle encoder (not shown), as well as managing the arc striking event of each injection cycle.

The choke coil 92 acts to sustain the arc as it increases in length, since its inductance generates an increased voltage as the current begins to decline, such as to supply the increased voltage necessary to sustain the arc.

Various alternate electrode geometries are possible. Instead of a widely dispersed fuel pattern, a more concentrated exit pattern is achieved by the electrode arrangement shown in FIG. 6.

In this embodiment, fuel enters through an annular passage 100 defined between a centrally located activating rod 102 driven by an actuator 104 and a bore 106 formed in a housing member 108. An insulating valve member 110 attached to the actuator rod 102 has a valving surface 112 mating with a valve seat 114 formed about the shoulder of the transition of bore 106 to a larger diameter bore 116 formed in housing member 108 which slidably mounts the valve member 110. A series of helical slots 118 establish swirl vanes to establish a vertical flow pattern therethrough, exiting in an annular space 120 defined between an upper electrode 122 and a lower housing sleeve 124. Upper electrode 122 is secured to activator rod 102 via threaded stem 126 to move therewith.

A lower electrode 128 is urged upward by a spring 130 into engagement with the upper electrode 122, mating hemispherical surfaces 132, 134 respectively brought into contact thereby. Spring 130 is seated against the inside of a retainer sleeve 131.

The upper electrode is formed with an open ended cavity 136 opposite a through bore 138 aligned therewith formed into the lower electrode 128.

Figure 6:
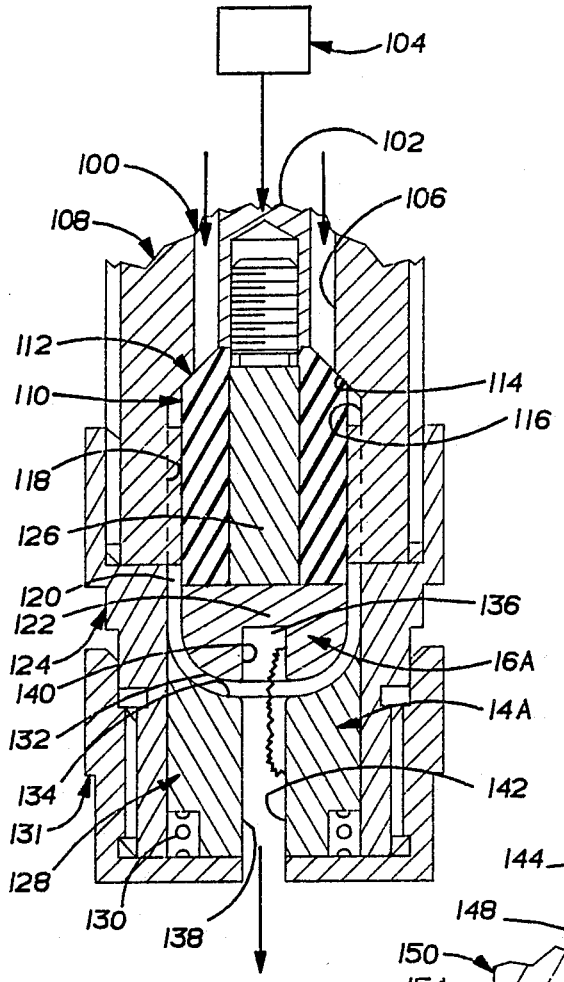
FIG. 6 is fragmentary sectional view of an alternate embodiment of the electrode arrangement according to the present invention.

Upon opening of the valve member 110 and exertion of fuel pressure on the lower electrode, separation occurs and fuel flow establishes the condition shown in FIG. 6, with the C shaped rotating arc extending between surfaces 140, 142 of the cavity 136 and bore 138 respectively. The activated fuel exits in the shape of a solid cone with a small included angle.

Figure 7:
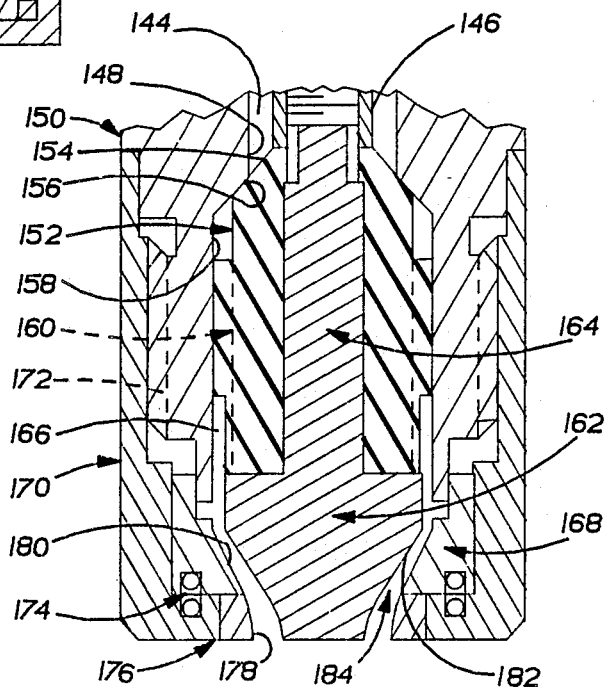
FIG. 7 is fragmentary sectional view of an alternate embodiment of the electrode arrangement according to the present invention.

A coaxial convergent electrode geometry is shown in FIG. 7, in which an annular fuel flow passage 144 is defined between an actuator rod 146 and a bore 148 of a housing member 150. A valving member 152 of electrically insulating material and having a tapered surface 154 mating with a tapered valve seat surface 156 of a transition to a large diameter bore 158 also formed in the housing member 150. In this embodiment, the vanes 160 are machined into the outside of valving member 152. A first electrode 162 is formed with a stem portion 164 threaded into the actuation rod 146 to also mount the valve member 152 thereto.

An annular clearance space 166 between the bore 158 and the valve member 152 and upper perimeter of a generally cylindrical portion of the electrode 162 define a continuation of the flow passage.

A lower electrode 168 is slidably fit into an outer electrode sleeve 170 threaded to housing member 150 at 172. Sleeve 170 also retains the electrode 168 and a spring 174 urging the electrode into contact with electrode 162 by an endwall 176 extending radially inward to an exit bore 178. A bore 180 is formed in electrode 168 having a diverging hyperbolic curve as does the lower outer surface 182 of the electrode 162. These surfaces collectively define an annular but convergent flow passage 184 such that the tangential component of fluid flow velocity accelerates as it progresses axially. The cross section area is maintained nearly constant so as to not cause an acceleration of the axial component, while relatively increasing the rotation of the arc to thereby lengthen the duration of the arc.

Opening of the valve member causes the electrode 168 to initially be moved downwardly with electrode 162. The subsequent establishment of pressure on surface 180 forces electrode 168 against endwall 176, thus forming the converging passage 184 shown in FIG. 7.

The tangential component of the fluid flow acts to cause rotation of the arc about the axis of the electrode and axially migrate down the passage as well.

Figure 8:
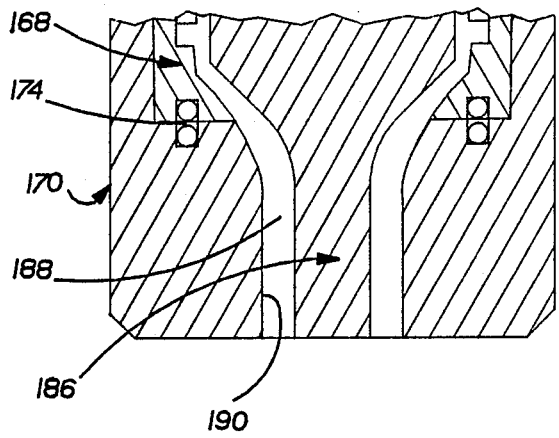
FIG. 8 is fragmentary sectional view of an alternate embodiment of the electrode arrangement according to the present invention.

Since the duration of the interval is related to the length of the flow passage, a longer interval can be obtained by adding to the length of the flow passage as shown in FIG. 8. A cylindrical electrode extension rod 186 extends from electrode 162 defining an annular passage 188 with a bore 190 in the electrode sleeve 170. Thus, the arc can continue to migrate down and around the passages 188.

Figure 9:
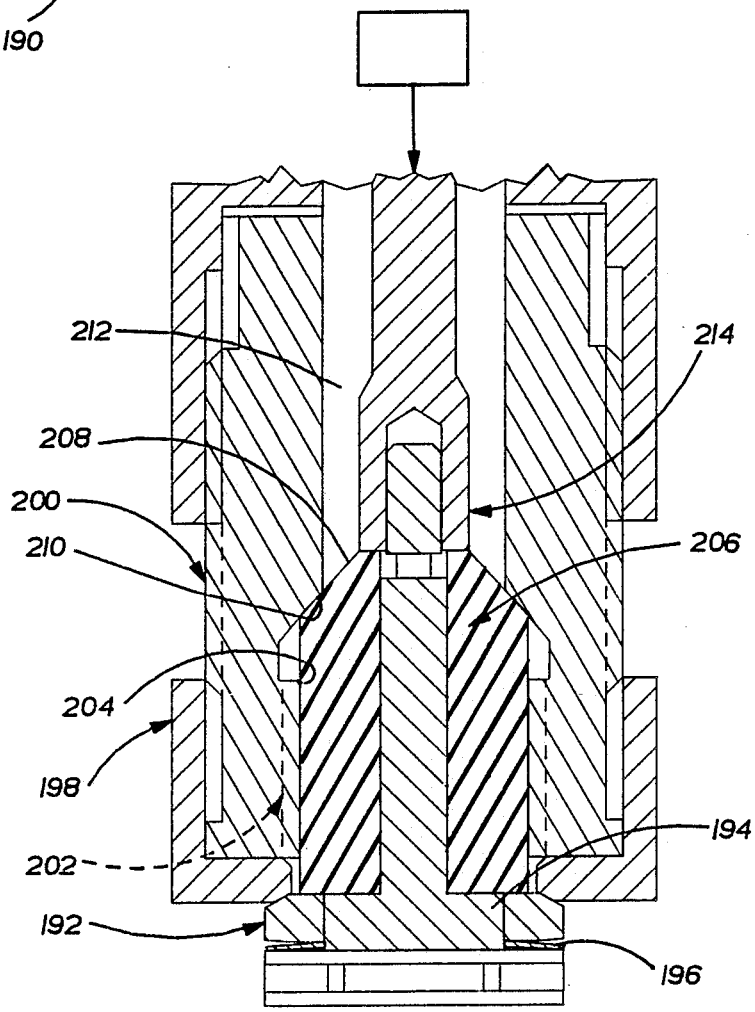
FIG. 9 is fragmentary sectional view of an alternate embodiment of the electrode arrangement according to the present invention.

A simple poppet valve electrode arrangement as shown in FIG. 9 may also be employed for short arc duration applications.

In this design an annular electrode 192 is slidably mounted to a stem 194. Spring 196 urges electrode 192 into contact with the fixed electrode sleeve 198 which is threaded to housing member 200. Housing member 200 has vane passages 202 machined into bore 204 receiving an electrically insulating valve member 206. Valve member 206 has a tapered surface 208 mating with a valve seat 210 to control communication of the annular flow passage 212 with the vane passages 202 by movement of the actuator rod 214.

Upon lowering of the rod 214, flow is initiated and at the same time an arc is drawn by separation of the electrodes 192 and 198. The tangential component of fuel flow tends to rotate the arc about the electrodes 192, 198.

Since the axial path is limited, arc duration is relatively short, but a good cone shaped fuel flow pattern is obtained.

Many other variations of the separated electrode geometry are of course possible.

What is claimed is:

1. An electrode arrangement for establishing a sustained electrical arc comprising:

housing means;

a first electrode having an annular contact surface;

a second electrode having an annular contact surface;

mounting means mounting said first and second electrodes in said housing means with said respective annular contact surfaces axially aligned, said mounting means further mounting said first and second electrodes so as to be axially movable relative each other, between a first position having said annular contact surfaces in contact with each other and a second position whereat said annular contact surfaces are axially spaced apart to form an arc gap space therebetween;

moving means for relatively moving said electrodes axially between said first and second positions;

arc driver circuit means causing a current to flow between said electrodes with said electrodes in said first position and continuing to cause said current to flow as said electrodes are moved axially from said first to said second position, whereby an arc is established as said electrodes are moved apart with said current flowing; an annular space formed between said electrodes upon relative movement of said electrodes from said first to said second position; and, means for causing said arc to rotate about said annular space upon establishing said arc.

2. The arrangement according to claim 1 wherein said first electrode comprises a cylindrical element having an open faced cavity in one end thereof, a rim of said cavity forming said annular surface of said first electrode; said second electrode also formed with an open faced cavity opposite said one end of said first electrode, a rim of said second electrode forming said annular surface of said second electrode.

3. The arrangement according to claim 2 wherein said second electrode includes a skirt portion extending from said rim towards said first electrode and receiving said first electrode with a clearance therebetween.

4. The arrangement according to claim 3 wherein said skirt portion is slidably mounted in said housing, further including an electrically insulating sleeve surrounding said skirt portion.

5. The arrangement according to claim 4 wherein said second electrode is formed with a radially protruding flange and further including a spring confined within said housing and engaging said flange; said housing electrically connected into said arc driver circuit to carry said current from said second electrode to said flange and spring comprising the sole electrical contact between said second electrode and said housing.

6. The arrangement according to claim 1 further including flow passage means adjacent said annular space directing fluid flow therein in a tangential direction whereby a vertical flow may be established in said annular space by directing flow through said flow passage means, said vertical flow comprising said means for rotating said arc.

7. The arrangement according to claim 6 wherein said flow passage means includes a spiral recess surrounding said first electrode axially spaced from said annular space but in fluid communication therewith.

8. The arrangement according to claim 6 wherein one of said electrodes includes a generally tapering portion thereof, and said second electrode is formed with a generally tapering surface receiving said tapering portion of said first electrode, said annular space lying therebetween with said electrodes in said separated condition.

9. The arrangement according to claim 8 wherein said generally tapering portion and bore are each hyperbolically shaped and increase the space therebetween along the axial direction from a line of contact established therebetween with said first and second electrodes in said first position.

10. The arrangement according to claim 8 further including a rod extension extending away from the center of said tapering portion of said first electrode member at the smaller diameter side thereof, and a constant diameter bore formed in said second electrode extending from the smaller diameter side of said tapering bore in juxtaposition to said extension rod.

11. The electrode arrangement according to claim 8 further including a through bore in said second electrode aligned with and extending away from said tapering surface.

12. The electrode arrangement according to claim 6 further including a series of tangentially extending orifice jets extending into said cavity of said second electrode axially spaced away from said annular surface thereof.

13. The electrode arrangement according to claim 1 further including a valve member attached to said first electrode to be movable therewith, and a valve seat mating with said valve member with said first and second electrodes in said first position but said valve member unseated therefrom with said first and second electrodes in said second position; fluid flow passage means in communication with said arc gap space only with said valve member unseated from said valve seat.

14. The electrode arrangement according to claim 1 further including means fixing said first electrode and means mounting said second electrode for movement towards and away therefrom, with spring means comprising in part said moving means for relatively moving said electrodes between said first and second portions, said spring means urging said second electrode towards said first electrode, and wherein said moving means also includes means for controllably applying fluid pressure to said second electrode moving the same away from said first electrode to create said arc gap space.

* * * * *